US006161456A

United States Patent [19]

Langford

[11] Patent Number: 6,161,456

[45] **Date of Patent: *Dec. 19, 2000**

[54] SHIELDED SPIKE TOOL

[76] Inventor: Don C. Langford, 3602 W. Clarendon, Phoenix, Ariz. 85019

[ * ] Notice: This patent is subject to a terminal disclaimer.

[21] Appl. No.: 09/198,549

[22] Filed: Nov. 24, 1998

Related U.S. Application Data

[60] Provisional application No. 60/066,954, Nov. 26, 1997.

[51] Int. Cl.[7] ..... B25B 23/08

[52] U.S. Cl. ..... 81/451; 81/441; 81/461

[58] Field of Search ..... 81/461, 451, 452, 81/176.2, 176.15, 441

[56] References Cited

U.S. PATENT DOCUMENTS

| | | | |
|---|---|---|---|
| 2,698,637 | 1/1955 | Donovan | 81/451 |
| 2,881,648 | 4/1959 | Hottle . | |
| 4,426,896 | 1/1984 | Kesselman . | |
| 4,542,666 | 9/1985 | White . | |
| 4,679,468 | 7/1987 | Gray . | |
| 4,800,788 | 1/1989 | Goldstein | 81/451 |
| 5,056,386 | 10/1991 | Chaconas | 81/451 |
| 5,272,943 | 12/1993 | Edwards | 81/461 |
| 5,458,030 | 10/1995 | Betts | 81/451 |
| 5,865,078 | 2/1999 | Langford | 81/441 |

*Primary Examiner*—Eileen P. Morgan
*Assistant Examiner*—Joni B. Danganan
*Attorney, Agent, or Firm*—Parsons & Goltry; Robert A. Parsons; Michael W. Goltry

[57] ABSTRACT

A shielded spike tool for removing and installing spike elements from sports shoes, the shielded spike tool including a tool head with an engagement structure extending from a first surface thereof, and a shank extending from a second surface thereof, opposite the engagement structure. A shield is carried by the shank and encircles the tool head. The shield is movable along the shank between an extended position and a retracted position, with a biasing structure urging the shield into the extended position.

4 Claims, 1 Drawing Sheet

30
34
32
52
50
53
54
14
20
17
15
10
13
12
22
43
45
44
38
42
35
55
57
58
59
65
67
68
70
33
39

SHIELDED SPIKE TOOL

This application claims the benefit of U.S. Provisional Application Ser. No. 60/066,954, filed Nov. 26, 1997.

FIELD OF THE INVENTION

This invention relates to accessories for sporting equipment.

More particularly, the present invention relates to the installation and removal of spikes from sports shoes.

In a further and more specific aspect, the present invention concerns tools for the removal of worn and damaged spikes from sports shoes.

BACKGROUND OF THE INVENTION

The usable life of sports shoes is currently extended by utilizing replaceable spikes. Replaceable spikes are used in a wide variety of sports shoes, including shoes for golf, football, soccer, track etc. While effectively increasing the life of sports shoes, removable spikes are often difficult to remove. This difficulty arises from the tools currently used for spike removal. Often, spikes have a pair of apertures configured to receive the pins of a spanner type tool. The pins are inserted into the apertures and the spike can then be unthreaded from the shoe. This approach works very well in theory, but has problems in practical application. When a spike element is used over a period of time, dirt pebbles and other extraneous material can become jammed into the apertures, preventing insertion of the pins from the spanner tool. When this occurs, the apertures must be cleaned out, which is often difficult if not impossible. Furthermore, after much use, the base of the spike elements become worn and battered. This is precisely when a spike element should be replaced. However, much of the time the apertures become deformed and will not receive the pins of the spanner, or they become so worn down that the apertures have very little depth and will not retain the pins during removal of the spike element. Therefore, it is when the spike elements should be replaced that removal becomes a problem.

Spike removal tools have currently been developed which employ a tool head having engagement elements for engaging the surface of the spike element. These tools are employed with a power drill to increase the speed and ease of removing spikes from sports shoes. Thus, spikes can be removed even when they are worn, deformed, or otherwise damaged. There can arise, however, alignment, and safety issues. The tool must be well centered to efficiently operate. Furthermore, when employed to remove or even install a spike element, slippage can occur. This is particularly true if the tool is not well centered when beginning the removal. When this happens, the engagement elements, which are often sharp, may leave the spike element.

It would be highly advantageous, therefore, to remedy the foregoing and other deficiencies inherent in the prior art.

Accordingly, it is an object of the present invention to provide a new and improved spike tool.

Another object of the present invention is to provide a spike tool which will remove worn and damaged spike elements.

And another object of the present invention is to provide a spike tool which is shielded to facilitate alignment of the engagement elements with the spike element.

Still another object of the present invention is to provide a spike tool which is shielded for safety.

Yet another object of the instant invention is to provide a spike tool which is easily and quickly aligned.

SUMMARY OF THE INVENTION

Briefly, to achieve the desired objects of the instant invention in accordance with a preferred embodiment thereof, provided is a shielded spike tool for removing and installing spike elements from sports shoes. The shielded spike tool includes a tool head, a shank extending from the tool head, and a shield carried by the shank and encircling the tool head. The shield is movable along the shank between an extended position and a retracted position.

In a more specific aspect, the shielded spike tool includes a biasing structure which urges the shield into the extended position. The biasing structure includes a base fixed to the shank, and a biasing element carried between the base and the shield. In yet another aspect, the base includes a periphery from which a continuous sidewall extends. The continuous sidewall is sized to receive the shield in the retracted position.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figures 1, 2, 3, 4, 5:
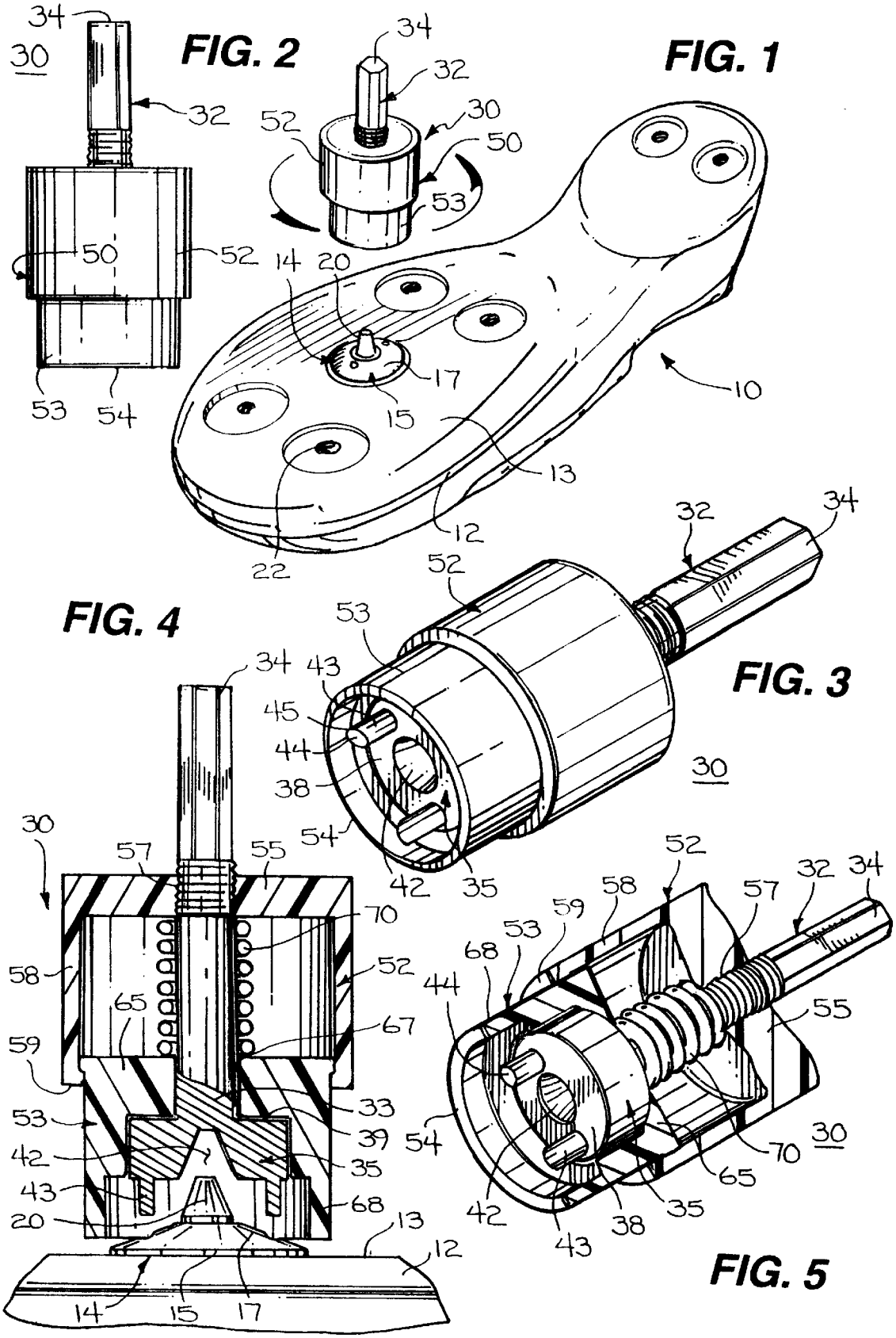
FIG. 1 is a perspective view illustrating a spike removal tool constructed in accordance with the teachings of the present invention, as it would appear being employed to remove a spike element from a shoe.
FIG. 2 is a side elevation of the spike removal tool of FIG. 1.
FIG. 3 is a perspective view of the spike removal tool of FIGS. 1 and 2.
FIG. 4 is a sectional side view of the spike removal tool of FIGS. 1–3, as it would appear with a shield engaging a spike element in the extended position.
FIG. 5 is a perspective view of the spike removal tool of FIGS. 1–4, as it would appear with portion of the shield broken away for purposes of illustration.

Turning now to the drawings in which like reference characters indicate corresponding elements throughout the several views, attention is first directed to FIG. 1 which illustrates a sport shoe generally designated 10. Sport shoe 10 is specifically illustrated as a golf shoe including a sole 12, a bottom surface 13 and a plurality of spike elements 14 extending therefrom. It will be understood that other types of shoes employing removable spike elements, such as football shoes, soccer shoes, track shoes, etc., may be serviced by the present invention, and that golf shoe 10 is shown solely for purposes of reference.

With additional reference to FIG. 4, it can be seen that spike element 14 includes a disk shaped base 15 having an outer surface 17 from which a spike 20 projects. Not shown, but well understood by those skilled in the art is a threaded post extending from base 15 opposite spike 20. The threaded post is received by a threaded socket 22 formed into sole 12. Spike element 14 is rotated in a first direction for installation and rotated in a second direction for removal. It is conventional for threaded elements to be rotated in a clockwise direction for engagement and counterclockwise for removal, but it will be understood that the directions may be reversed. It will be understood that the term spike element is intended to include various sporting shoe removable spikes and cleats.

Still referring to FIG. 1 with additional reference to FIG. 3, when spike elements 14 become worn, deformed or otherwise rendered difficult to remove, a spike tool generally designated 30 is employed to aid in removal. Spike tool 30 includes a shank 32 having opposing ends 33 and 34, and a tool head 35 coupled to end 33. End 34 is configured to be received by a rotating device such as a drill (not shown). In this embodiment, it is assumed that a counter-clockwise rotation of spike element 14 will remove it from shoe 10. Therefore, the drill must be reversible to rotate spike tool 30 in a counter-clockwise direction. It must be noted that clockwise removal of spike element 14 may also be possible. It should also be noted that spike element 14 can be installed using spike tool 30. Those skilled in the art will understand that spike elements serviced by tool 30 include removable cleats, spikes and alternative cleats and spikes.

Turning now to FIGS. 4 and 5, tool head 35 is generally cylindrical and includes a first surface 38, a second surface 39 opposing first surface 38, an engagement structure carried proximate first surface 38 for engaging disk shaped base 15 of spike element 14, and a bore 42 extending centrally through first surface 38 into tool head 35 toward second surface 39 along an axis of rotation of tool head 35. Shank 32 extends generally centrally from second surface 39 of tool head 35 and has an axis of rotation generally perpendicular to first surface 38 of tool head 35 and co-axial with bore 42. The engagement structure preferably consists of projections for engaging spike element 15, and in this embodiment, includes a pair of pins 43 extending from first surface 38. Pins 43 terminate in a slanted surface 44 providing a relatively sharp edge 45 which engages outer surface 17 of spike element 14. While two pins 43 are used in spaced apart relation, it will be understood that more pins may be employed, and even one pin may be employed if desirable. Furthermore, it will be understood that substantially any engagement structure such as spikes, blades, etc. projecting from a planar, convex, concave, etc. surface may be employed.

As can be seen with reference to FIGS. 1–3, tool head 35 is enclosed by a shield structure 50. Shield structure 50 includes an outer shield 52 and an inner shield 53. Prior to engagement with a spike element, inner shield 53 encloses tool head 35, and has a rim 54 which extends past pins 43. Outer shield 52 has an inner diameter larger than an outer diameter of inner shield 53 and is fixedly coupled to shank 32 as will be described presently.

Turning now to FIGS. 4 and 5, outer shield 52 includes a base 55 having a central aperture 57 and a continuous sidewall 58 extending from the periphery thereof. Sidewall 58 has an inner diameter and terminates in a rim 59. Base 55 is coupled to shank 32 so as to be immovable therealong, with shank 32 extending through aperture 57. In the present embodiment, shank 32 is threaded through aperture 57. However, one skilled in the art will understand that base 55 may be welded, adhered, pinned or otherwise fixed to prevent translation along shank 32. While base 55 must not move along shank 32, rotation of base 55 will not affect the operation of the device. Furthermore, while outer shield 52, in this embodiment, includes sidewall 58, this is not an essential feature and may be omitted.

Inner shield 53 includes a base 65 having a central aperture 67 and a continuous sidewall 68 extending from the periphery thereof. Sidewall 68 has an inner diameter larger than the diameter of tool head 35 and slightly larger than the diameter of spike element 14, an outer diameter slightly smaller than inner diameter of outer shield 52, and terminates in rim 54. Shank 32 is slideably received within aperture 67. Thus, inner shield 53 is movable between a normally extended position in which it encloses tool head 35, and a retracted position in which it is received within outer shield 52. A biasing member 70, which in this embodiment is a compression spring, is carried by shank 32 between base 55 and base 65. Biasing member 70 is compressed between bases 55 and 65, and urges inner shield 53 away from outer shield 52, into the extended position. In this position, rim 54 is extended past pins 43.

Referring specifically to FIG. 4, in operation spike tool 30 is placed in contact with spike element 14 by placing tool head 35 directly over spike 20 of spike element 14. This is quickly and easily accomplished because inner shield 53 aligns tool head 35 when rim 54 is placed around spike element 14. It will be understood that while the inner diameter of inner shield 53 is preferably larger than the diameter of the spike element, some spike elements may have a large base 15. In this instance, rim 54 may ride upon the edge of base 15 of the spike element. In the illustration, inner shield is in the extended position. As can be seen tool head 35 does not engage spike element 14. A slight pressure to overcome the bias of bias member 70 will move inner shield 53 to the retracted position and engage pins 43 with outer surface 17. Spike 20 is received within bore 42 permitting pins 43 to fully contact outer surface 17 of spike element 14. Bore 42 may extend completely through tool head 35 and into shank 32 to accommodate longer spikes.

Spike element 14 is removed by rotating spike tool 30 in the direction of removal, generally counter-clockwise, which engages pins 43 with outer surface 17. As spike element 14 is removed, inner shield 53 remains in contact with sole 12 preventing slipping of tool head 35 and preventing pins 43 from causing injury to the operator. As spike element 14 is unthreaded from socket 22, tool head 35 is forced away from sole 12. However, rim 54 of inner shield remains in contact with sole 12 as it is moved out to the extended position. In this manner, spike tool 30 will not slip since inner shield 53 encloses spike element 14 holding the tool in place until spike element 14 is completely removed.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A shielded spike tool for removing and installing spike elements from sports shoes, the shielded spike tool comprising:

a tool head including at least two engagement structure extending from a first surface thereof, each having a cutting edge for engaging spike elements;

a shank extending from a second surface of the tool head opposite the engagement structure;

a shield including a base having a central aperture slidably receiving the shank, and a continuous sidewall extending from a periphery thereof, terminating in a rim sized to receive the spike element therein, the shield encircling the tool head and movable along the shank between an extended position wherein the rim extends passed the engagement structure, and a retracted position wherein the rim is behind the engagement structure, the central aperture having a diameter smaller than the tool head to prevent removal of the shield past the tool head; and a biasing structure carried by the shank, urging the shield into the extended position.

2. A shielded spike tool as claimed in claim 1, wherein the biasing structure includes a base fixed to the shank, and a biasing element carried between the base and the shield.

3. A shielded spike tool as claimed in claim 2 wherein the base includes a periphery from which a continuous sidewall extends, the continuous sidewall receiving the shield in the retracted position.

4. A shielded spike tool as claimed in claim 3, wherein the biasing element includes a compression spring carried by the shank.

* * * * *